US005664797A

United States Patent [19]

Haughlin

[11] Patent Number: 5,664,797

[45] Date of Patent: Sep. 9, 1997

[54] CROSS-COUNTRY SKI BINDING AND COMPLEMENTARY CROSS-COUNTRY SKI BOOT

[76] Inventor: Bernt-Otto Haughlin, Fossumvn 2, N-3440 Royken, Norway

[21] Appl. No.: 697,483

[22] Filed: Aug. 26, 1996

Related U.S. Application Data

[63] Continuation of Ser. No. 306,269, Sep. 14, 1994, abandoned.

[30] Foreign Application Priority Data

Sep. 14, 1993 [DE] Germany ..... 43 31 197.0
Dec. 20, 1993 [DE] Germany ..... 43 43 485.1

[51] Int. Cl.[6] ..... A63C 9/00

[52] U.S. Cl. ..... 280/615; 280/633; 280/636; 280/809; 36/117.2

[58] Field of Search ..... 280/611, 613, 280/615, 623, 631, 633, 634, 636, 809; 36/117.1, 117.2, 117.3

[56] References Cited

U.S. PATENT DOCUMENTS

| | | | |
|---|---|---|---|
| 2,516,238 | 6/1950 | Mortsell | 36/117 |
| 2,950,118 | 8/1960 | Sharpe | 280/611 |
| 3,984,124 | 10/1976 | Gertsch | 280/636 |
| 4,098,010 | 7/1978 | Rothmayer | 280/613 |
| 4,177,584 | 12/1979 | Beyl | 280/613 |
| 4,487,427 | 12/1984 | Salomon | 36/117 |
| 4,505,057 | 3/1985 | Kiester | 36/117 |
| 4,915,406 | 4/1990 | Graillat | 280/615 |
| 4,995,632 | 2/1991 | Girault et al. | 280/631 |
| 5,076,604 | 12/1991 | Wittmann et al. | 280/633 |
| 5,085,454 | 2/1992 | Provence et al. | 280/634 |
| 5,088,757 | 2/1992 | Hauglin | 280/636 |

FOREIGN PATENT DOCUMENTS

| | | | |
|---|---|---|---|
| 0136310 | 5/1988 | European Pat. Off. . | |
| 2642980 | 8/1990 | France | 280/615 |
| 2697140 | 4/1994 | France | 36/117 |
| 3320559 | 6/1983 | Germany . | |
| 3915531 | 1/1990 | Germany | 280/615 |
| 4733 | 1/1896 | Norway | 280/615 |
| 94021148 | 9/1994 | WIPO | 36/117 |

*Primary Examiner*—Brian L. Johnson
*Assistant Examiner*—Min Yu

[57] ABSTRACT

In a combination of a cross-country ski binding and a complementary cross-country ski boot, the boot comprises engagement elements in the front part of its sole which are complementary to and insertable into engagement elements of the binding to form a joint-like connection. The engagement elements of the sole comprise a joint axle oriented transversely to the long direction of the ski and substantially parallel to the undersurface of the boot. The complementary engagement elements of the binding comprise a retaining hook with a U-shaped stirrup piece that forms a hinge joint with the joint axle by enclosing it from behind and which can be moved out of a closed position into a boot-release position and conversely. The joint-like connection between joint axle and retaining hook or associated stirrup piece is so arranged that the undersurface of the boot is held against the upper surface of the ski body in the ball region of the boot. In addition, there is provided an resiliently deformable element or flexor that acts between the undersurface of the boot and the upper surface of the ski body so that the boot is resiliently supported against the upper surface of the ski body in the region between the jointlike connection and the front or toe end of the binding.

25 Claims, 6 Drawing Sheets

FIG. 1
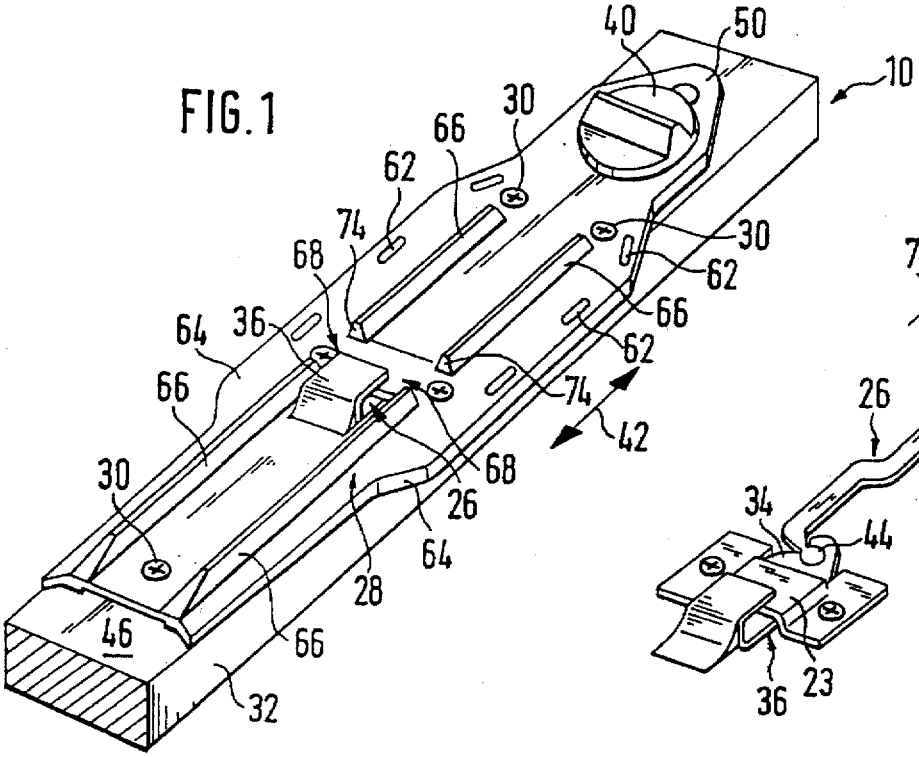
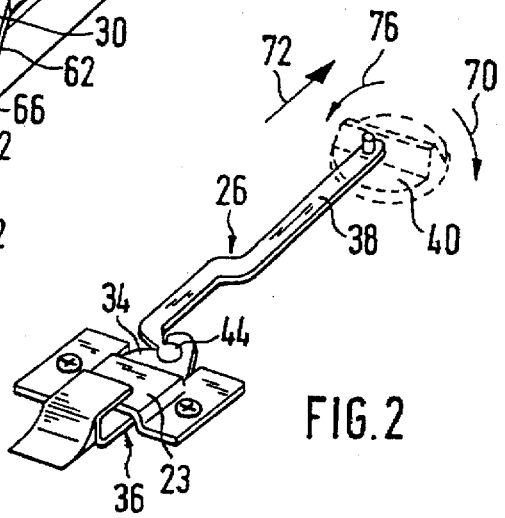
FIG. 2
FIG. 3
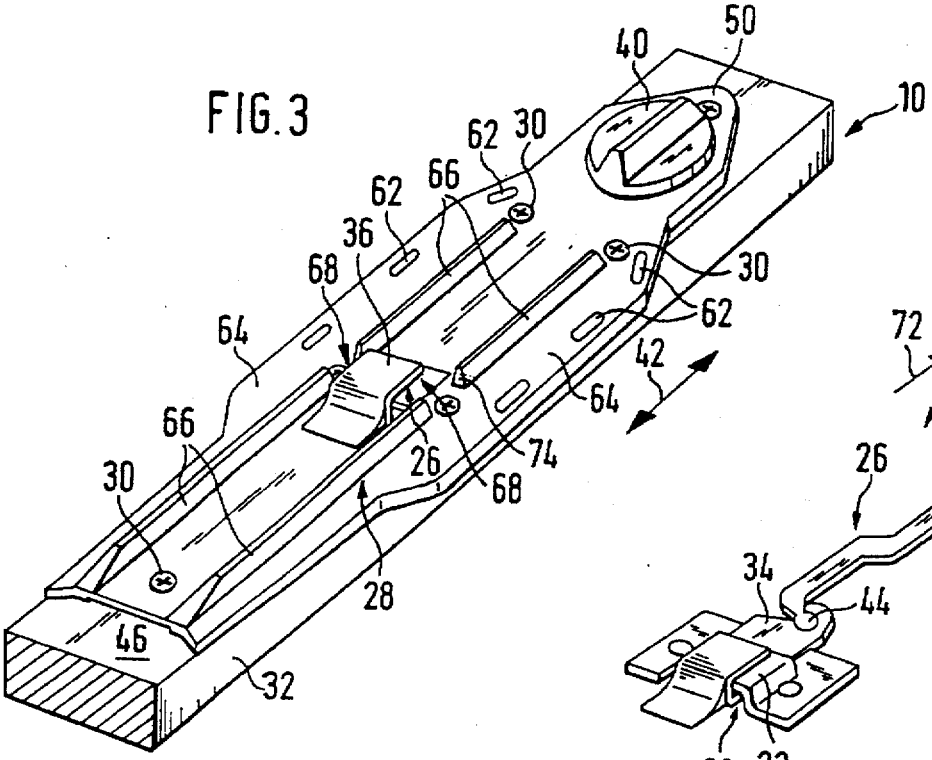
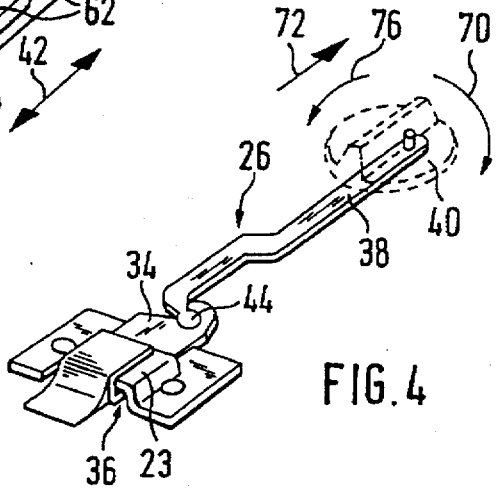
FIG. 4

CROSS-COUNTRY SKI BINDING AND COMPLEMENTARY CROSS-COUNTRY SKI BOOT

CROSS REFERENCE TO RELATED APPLICATION

This application is a continuation of application Ser. No. 08/306,269, filed Sep. 14, 1994 abandoned.

FIELD OF THE INVENTION

The present invention relates to a cross-country ski binding and a complmentary cross-country ski boot.

DESCRIPTION OF THE PRIOR ART

In known cross-country ski bindings and their complmentary cross-country ski boots, the boot comprises engagement elements at the toe end of the sole which are complementary to and insertable into engagement elements of the binding, to produce a jointlike connection. The engagement elements on the sole comprise a joint axle oriented perpendicular to the long axis of the ski and substantially parallel to the undersurface of the sole of the boot. The complementary engagement elements of the binding comprise a retaining hook that engages the joint axle from behind and forms a hinge joint therewith. The retaining hook itself can be moved out of a locking position into a releasing position and the reverse. Although these arrangements in practice have proved their value for general cross-country skiing, their suitability for the "skating" technique is limited. "Skating" denotes a means of locomotion in which the skis are moved as though they were skates, which is recently becoming increasingly significant as a particularly rapid means of locomotion, especially in competitive sport. In the conventional cross-country ski bindings the jointlike connection between joint axle on the one hand and the retaining hook of the binding on the other is situated at or even ahead of the front end of the sole. As a result, nearly the entire sole of the cross-country ski boot can be lifted up from the upper surface of the body of the ski. Precise guidance of the ski and maximal transfer of force to the body of the ski is unattainable, or at least attainable only to a limited extent, with this arrangement.

In EP 0 136 310 B1 a combination of a cross-country ski binding and a matching boot is described, in which the cross-country ski binding comprises a coupling element which at its end towards the front of the ski can be joined to the body of the ski and which at it end towards the rear of the ski can be connected to the boot in the region of the ball of the foot. The coupling element is made flexible in such a way that during cross-country skiing the heel of the boot can be lifted freely, as it can with conventional cross-country ski bindings. However, this combination is also unusable for competitive sport because it does not have sufficient lateral stability to make it suitable for "skating".

SUMMARY OF THE INVENTION

The object of the present invention is to provide a combination of a cross-country ski binding and a complementary cross-country ski boot which is relatively simple and compact in construction and enables both precise guidance of the ski and maximal transfer of force to the body of the ski.

According to a first aspect of the present invention there is provided a combination of a cross-country ski binding and a complementary cross-country ski boot which can be secured to one another to form a joint-like connection, wherein the ski boot comprises a sole having an undersurface comprising an engagement means in the form of a joint axle which is disposed in the ball region of the front part of the sole and which is oriented transversely to the long direction of the ski and substantially parallel to the undersurface; wherein the ski binding comprises a complementary engagement means at least partially in the form of a retaining hook that can be moved between a first position, wherein it forms a hinge joint with the joint axle of the boot by engaging with it from behind, and a second position, wherein the boot is released from engagement with the binding; and wherein a resiliently deformable element is disposed in front of the joint axle at the toe-end of the joint-like connection to act between the sole and an upper surface of a ski to which the binding is connected.

The result of the combination of a cross-country ski binding and a complementary cross-country ski boot configured in accordance with the invention is that the construction of the components is made relatively simple and compact. Furthermore, this configuration provides for exact guidance of the ski and maximal transfer of force to the body of the ski because the ball of the ski hoot is always in a position to transmit force directly to the upper surface of the ski. It is still possible to lift the heel of the hoot slightly from the ski surface, but not the whole sole of the boot. Thus, by this means, in particular for "skating", the skis can be guided with great precision and a maximal amount of force can be transferred to the ski body. The combination in accordance with the invention is thus particularly good for ski racing. At the same time, however, care is taken to ensure an anatomically and biomechanically adjusted interplay between ski binding and ski boot, such that rolling-off and gripping movement of the foot, although limited, is not impeded by unnatural bending of the toe joints, because of the resiliently deformable element (flexor) that provides resilience in a direction approximately perpendicular to the upper surface of the body of the ski.

Preferably, the resiliently deformable element comprises a flexor constructed so that the region of the sole between the ball region and its front end can be swiveled about the jointlike connection against the action of the flexor at angles in the range of 2° to 12°. This is of significance in enabling a natural and hence comfortable rolling-off and gripping movement of the foot.

Preferably also, the undersurface of the sole curves upwardly from the joint-like connection towards the front end of the sole. The ski boot thus allows movements corresponding to those executed in a normal walking shoe. Premature fatigue of the foot or the foot musculature and hence of the cross-country skier is prevented because the toes are not squeezed in the front part of the boot.

In this regard, the undersurface of the sole preferably curves upwardly so as to form an angle in the range of 2° to 12° with respect to a horizontal plane passing through the jointlike connection.

To maintain a reliable functionality of the combination, even for example in deep or new snow, preferably between the front part of the sole and the upper ski surface is defined a space which is delimited laterally by a snow-excluding means. This keeps the undersurface of the sole of the boot free of snow in the region between the ball and the front end of the sole. This measure prevents the limited space between the undersurface of the sole of the boot in the region between ball and front end and the upper surface of the body of the ski or of the binding from becoming packed with snow. The natural rolling-off and gripping movement of the foot thus cannot be impaired by penetrating snow or the like.

The snow-excluding means is preferably substantially U-shaped and matched to the profile of the undersurface of the sole in the region between ball region and front end of the sole. The snow-excluding means can thus be apposed to the cross-country ski boot practically without play.

It is also especially advantageous with respect to construction and manufacturing technology that the snow-excluding means is resiliently deformable and preferably formed integrally with the flexor.

Preferably also, either the flexor or the snow-excluding means is attached to the binding. This renders the construction simple but at the same time highly reliable. It is nevertheless likewise within the scope of the present invention for the flexor in particular, but also the snow-excluding means to be attached to the undersurface of the sole itself or to be made integral therewith.

Preferably also, either the flexor or the snow-excluding means can be attached to the binding by means of a snap-fit device, catch or similar means.

Preferably, in order to facilitate guidance of the ski during "skating", the binding comprises a widened region which projects beyond the upper surface of the ski in the area which lies adjacent the region of the ball and the front part of the sole of the boot. This widened region also provides support surfaces for the snow-excluding means.

Preferably also, the binding comprises a case and the retaining hook comprises a flat element that can be slid back and forth in the long direction of the ski within the case, the back end of the hook having portions which extend upwardly and forwardly to define a U-shaped stirrup member that in the first position cooperates with the binding case to secure the joint axle of the boot, and the front end of the hook being connected to an actuating means which is disposed in the case in such a way that movement of the actuating means is converted into a translational back-and-forth movement of the retaining hook.

The actuating means is preferably a pivotally mounted element to which the front end of the retaining hook is eccentrically connected, an articulation being provided between the front end of the retaining hook and the U-shaped stirrup member.

In order to provide a simple but simultaneously very compact combination of ski binding and ski boot, the retaining hook is preferably disposed between at least two substantially parallel guide ribs which are oriented in the long direction of the ski and which each define a gap in the region immediately ahead of the retaining hook to receive the joint axle of the boot.

To additionally simplify the construction of the combination, the guide ribs are preferably integrally formed with the binding.

In order to ensure precise guidance of the ski and good transmission of force to the ski in every rotational position of the cross-country ski boot and in all conditions of imposed load, a resiliently mounted sole-contact element is preferably provided between the sole and the upper surface of the ski in the region in front of the joint axle. The main aim here is to give the skier the feeling that the front part of the boot sole is always in contact with the ski over its whole area. The feeling of force transmission and control of the ski should thus be considerably improved.

This arrangement also enables precise guidance of the ski and maximal force transmission to it because the force is transferred to the upper surface of the body of the ski by way of the cross-country ski boot in the region of the ball. Hence the undersurface of the sole can be genuinely lifted away from the upper surface of the ski only in the heel region of the boot.

Also in this arrangement, the part of the cross-country ski boot sole ahead of the jointlike connection is applied, in every position of the cross-country ski boot and in all conditions of imposed load, to the sole-contact element disposed between the sole and the upper surface of the ski, which can be swiveled against the action of the the resiliently deformable element. Good transmission of force from the cross-country ski boot to the ski and precise ski guidance are thus possible regardless of whether the front part of the sole is fully, only partially or not at all loaded.

Preferably, the sole-contact element is connected to the upper surface of the ski by a hinge joint, the axle of which is oriented parallel to the upper surface of the ski and perpendicular to its long direction. This arrangement ensures a well-defined tilting movement in a plane perpendicular to the upper surface of the ski.

The force transmission is greatly improved when a substantial part of the front sole lies on the sole-contact element, and it is also useful to provide a bearing surface on the sole-contact element against which the front end of the sole abuts.

Tailored to the anatomy and the biomechanics of the foot, the sole-contact element can be tilted through an angular range from 2° to 12°, in particular from 2° to 8° and preferably from 4° to 6°.

In a preferred embodiment the above-mentioned bearing surface of the sole-contact element is oriented at an angle between approximately 70° and 170° with respect to the upper supporting surface of the sole-contact element.

For better sideways guidance of the cross-country ski, the sole-contact element comprises at least one guide rib that extends in the long direction of the ski and cooperates with an associated complementary groove defined on the underside of the sole of the cross-country ski hoot. Each guide rib is received in its complementary groove on the underside of the boot sole in every position of the boot and in all conditions of imposed load, so that good sideways guidance of the ski is ensured at all times. This is especially important for the above-mentioned "skating" movements.

The sole-contact element, the resiliently deformable element and the binding together preferably form a structural unit which is externally sealed so that no snow, ice or dirt can penetrate between the afore-mentioned individual components.

According to a second aspect of the invention there is provided a cross-country ski boot for a combination according to the first aspect of the invention, the boot comprising a sole having an undersurface comprising an engagement means in the form of a joint axle which is disposed in the ball region of the front part of the sole and which is oriented transversely to the long direction of the ski and substantially parallel to the undersurface. Such a cross-country ski boot ensures precise guidance of the ski as well as maximal force transmission to the body of the ski by way of the middle part of the foot, with no unnatural bending of the toe joints. This feature makes the cross-country ski boot in accordance with the invention particularly suitable for "skating".

In this regard it is preferable for the whole movement sequence, the anatomy and the biomechanics, for the undersurface of the sole to be curved upwardly, from the joint-axle towards the front end of the sole.

The undersurface of the sole preferably curves upwardly so as to form an angle in the range of 2° to 12° with respect to a horizontal plane passing through the joint-axle.

According to a third aspect of the present invention there is provided a cross-country ski binding for a combination according, to the first aspect of the invention, comprising a complementary engagement means at least partially in the form of a retaining hook that can be moved between a first position, wherein it forms a hinge joint with the joint axle of the boot by engaging with it from behind, and a second position, wherein the boot is released from engagement with the binding.

Additional characteristics, advantages and details of the invention will become apparent in the following description of some preferred embodiments of the invention, with reference to the accompanying drawings.

BRIEF DESCRIPTION OF THE DRAWINGS

FIG. 1 is a perspective view in a boot-release position of a cross-country ski binding according to the invention but without a flexor and a snow-excluding element;

FIG. 2 is a perspective view in the boot-release position of a locking mechanism for the binding shown in FIG. 1;

FIG. 3 is a perspective view of the embodiment shown in FIG. 1 when in a normal closed position;

FIG. 4 is a perspective view of the locking mechanism shown in FIG. 2 in the closed position;

DESCRIPTION OF THE PREFERRED EMBODIMENTS

Figure 5:
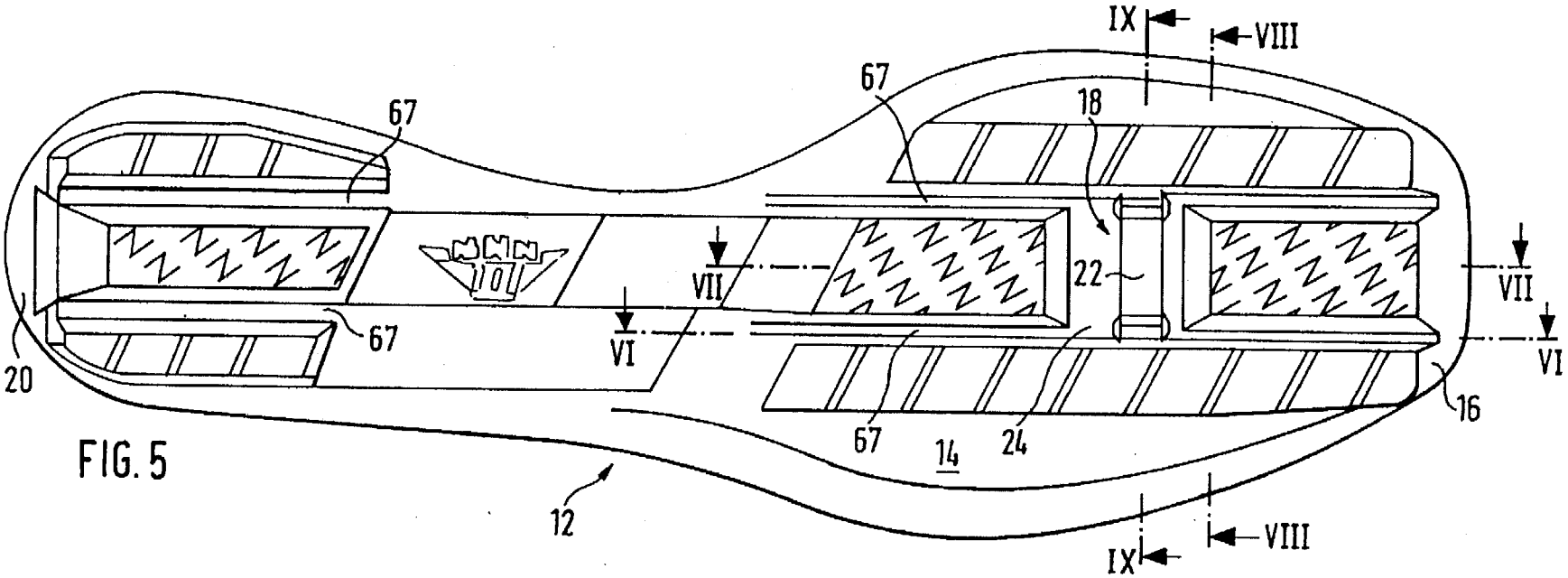
FIG. 5 is a view from below of an undersurface of a sole of a complmentary cross-country ski boot according to the invention.

The present invention comprises the combination of a cross-country ski binding 10, as shown in FIGS. 1 and 3, and a complementary cross-country ski boot 12, of which only its sole with undersurface 14 is shown in FIGS. 5 to 9. The undersurface 14 of the sole comprises a front toe end 16, a ball region 18 and a back heel end 20.

In the ball region 18 there are provided engagement elements complementary to and insertable into egagement elements in the binding 10, to produce a jointlike connection.

Figure 6:
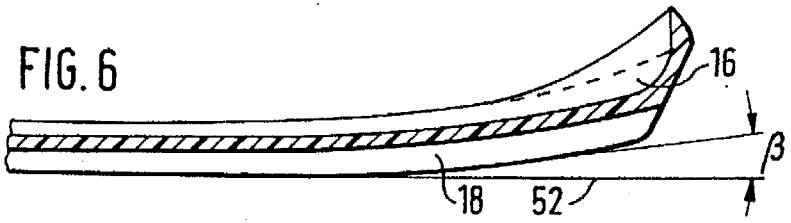
FIG. 6 is a partial longitudinal section along the line VI—VI through the sole shown in FIG. 5.
Figure 7:
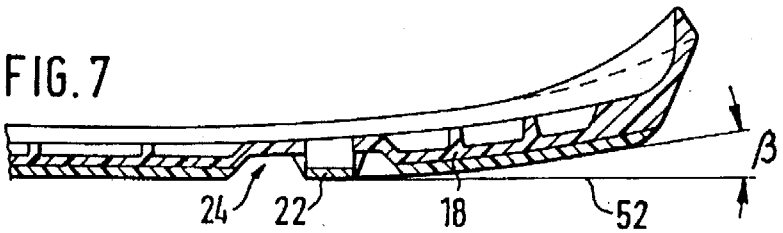
FIG. 7 is a partial longitudinal section along the line VII—VII through the sole shown in FIG. 5.
Figure 8:
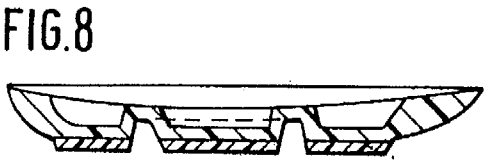
FIG. 8 is a transverse section along the line VIII—VIII through the sole shown in FIG. 5.
Figure 9:
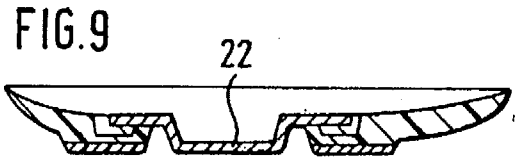
FIG. 9 is a transverse section along the line IX—IX through the sole shown in FIG. 5.
Figure 10:
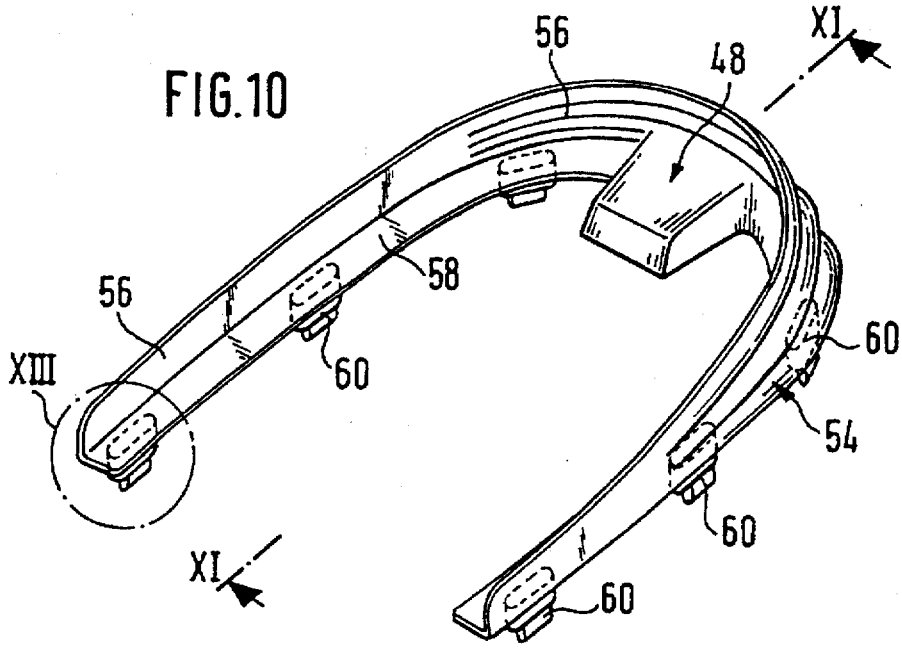
FIG. 10 is a perspective view of an embodiment of a flexor according to the invention, together with a bellows-like snow-excluding element.

As shown in FIGS. 5 to 7, the engagement elements on the sole side of the joint comprise a joint axle 22 in the form of a ridge, which is disposed in a recess 24 defined by the undersurface 14 of the sole and which is oriented perpendicular to the long direction of the sole and substantially parallel to the undersurface 14 of the sole.

As shown in FIGS. 1 to 4, the complementary engagement elements on the binding side of the joint comprise a retaining hook 26 that engages the joint axle 22 from behind to form a hinge joint. The retaining hook 26 can be moved out of a closed position, as shown in FIGS. 3 and 4, into a release position, as shown in FIGS. 1 and 2, and conversely.

The retaining hook 26 comprises a flat element of plastic or metal, in particular aluminum or stainless steel, disposed in a flat binding case 28, which can be attached to a ski body 32 by means of screws 30, in such a way that the retaining hook 26 can be slid back and forth in the long direction of the ski (double arrow 42). The retaining hook 26 is attached to the ski body 32 by a holding and guide strap 23 of plastic or preferably metal, which is fixed to the ski body 32 together with the binding case 28 by the screws 30. On the one hand the holding and guide strap 23, which is oriented perpendicular to the long direction of the ski and passes over the retaining hook 26 near the region where the boot is attached, i.e. at the back end 34 of the hook, serves to restrict the lateral movement of the retaining hook 26, leaving it displaceable in the long direction of the ski. On the other hand the holding and guide strap 23 holds the retaining hook 26 in place from above, so that the latter remains attached to the ski body 32 even under load. Because of the stable construction of the strap 23, which is made of a plastic or preferably metal, it reliably counteracts wear and tear in the region of the jointlike connection that would otherwise result from high tractive forces and torques.

The back end 34 of the retaining hook 26, with respect to the ski, is bent upward and over toward the front tip of the ski to form a U-shaped stirrup piece 36 which, in the closed position, cooperates with the binding case 28 to fix the joint axle 22 in the ball region of the boot sole. The front end 38 of the retaining hook 26, with respect to the ski, is connected to an actuating element 40 mounted on the binding case 28, in such a way that movement of the actuating element 40 is converted to a translational back-and-forth movement (double arrow 42) of the retaining hook 26 or stirrup piece 36.

In the embodiment of the binding 10 shown in FIGS. 1 to 4, the actuating element 40 is positioned at the front end 50 of the binding and has the form of a rotary disk to which the front end 38 of the retaining hook 26 is eccentrically attached. Instead of the rotary disk 40, a pivoted lever or the like can be provided. As shown in FIGS. 1 to 4, the retaining hook 26 is divided into two parts. The back end 34, which forms the U-shaped stirrup piece 36, and the front end 38 of the retaining hook 26, which is eccentrically attached to the actuating element 40, are connected to one another by a common articulation 44.

The jointlike connection between the joint axle 22 integrated with the sole and the retaining hook 26 is constructed in such a way that the undersurface 14 of the sole is held to the upper surface 46 of the ski body 32 in the ball region 18 of the boot.

Between the undersurface 14 of the cross-country ski boot 12 and the upper surface 46 of the ski body 32 or, here, the binding case 28 is disposed an resiliently deformable element comprising a flexor 48, as shown in FIGS. 10 to 14, to support the cross-country ski boot 12 resiliently against the upper surface 46 of the ski body 32 or against the upper surface of the binding case 28. The flexor 48 acts on the part of the sole between the jointlike connection and the front end 16.

Figure 11:
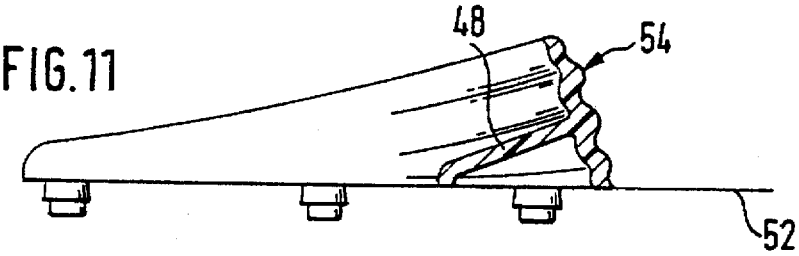
FIG. 11 is a longitudinal section along the line XI—XI of the snow-excluding element shown in FIG. 10 when in an unloaded state.
Figure 12:
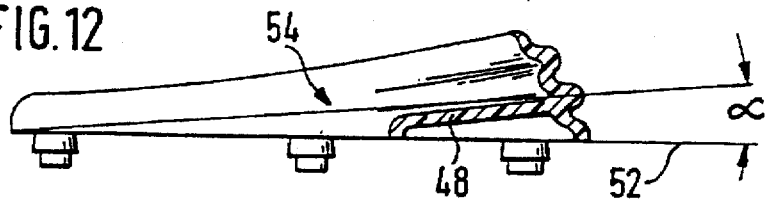
FIG. 12 is a longitudinal section along the line XII—XII of the snow-excluding element shown in FIG. 10 when in a loaded state.
Figure 13:
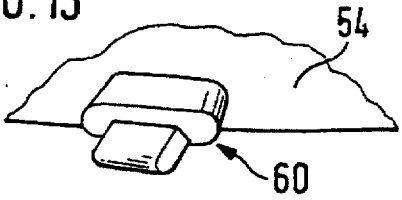
FIG. 13 is a perspective view to an enlarged scale of a detail of the snow-excluding element shown ringed and labelled XIII in FIG. 10.
Figure 14:
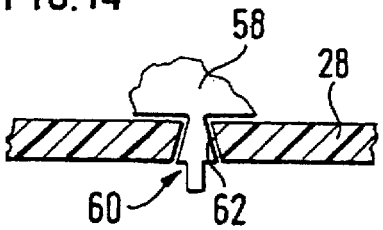
FIG. 14 is a longitudinal section to an enlarged scale of part of a binding case as shown in FIG. 1 showing the attachment thereto of the snow-excluding element shown in FIG. 13.

As is shown in FIGS. 11 and 12, the flexor 48 is formed in such a way that the undersurface 14 of the boot (not shown here) in the region between the ball 18 and the front sole end 16 can be pivoted against the flexor 48 so as to form an angle $\alpha$, with its apex at the jointlike connection, varying from approximately 2° to 12° , in particular 2° to 8° and preferably 4° to 6°. This feature allows a natural rolling-off and gripping movement of the foot to be preserved.

To further facilitate such a natural rolling-off and gripping movement of the foot, the undersurface 14 curves upward in the region between ball 18 and front end 16, starting from the joint axle and proceeding toward the front end 16 of the sole, as shown in FIGS. 6 and 7. The curvature of the undersurface 14 of the sole defines an angle $\beta$ of approximately 2° to 12°, in particular 2° to 8° and preferably 4° to 6° with respect to a horizontal plane 52 passing through the jointlike connection, which extends perpendicular to the plane of the page.

Returning now to FIGS. 10 to 14, associated with the flexor 48 is a bellows-like snow-excluding element 54 to keep the undersurface 14 of the sole of the cross-country ski boot 12 free of snow in the region between ball 18 and front end 16. The snow-excluding element 54 is substantially U-shaped but it is matched to the profile of the undersurface 14 of the sole of the cross-country ski boot 12 in the region between ball 18 and front end 16 of the sole.

As compared with the flexor 48, the snow-excluding element 54 is resiliently deformable. The snow-excluding element 54 in the illustrated embodiment is integrally formed with the flexor 48 and the flexor 48 and the snow-excluding element can be attached together to the binding case 28.

The snow-excluding element 54 itself comprises a substantially bellows-like wall 56 and a lower supporting rim 58, between which the flexor 48 is disposed. The bellows-like wall 56 extends upward substantially vertically at the sides and slants upward toward the back in the front region. The supporting rim 58 is continuous with the bottom edge of the wall 56 and extends radially inward, approximately in a horizontal direction. The flexor 48 is disposed on the inside, between the wall 56 and the supporting rim 58.

In order that the flexor 48 can be simply attached to the binding case 28 together with the snow-excluding element 54, on the under surface of the supporting rim 58 is provided a catch, snap-fit or similar device 60 in the form of a plurality of snap-fit lugs that can be inserted or snapped into correspondingly shaped apertures 62 in the binding case 28. It is equally possible for the flexor 48 and/or snow-excluding element 54 to be attached instead to the undersurface 14 of the sole of the cross-country ski boot 12.

To install the flexor 48 and the snow-excluding element 54 on the binding case 28, the binding case 28 is widened at least in the region of the ball 18 and the front end 16 of the sole of the cross-country ski boot, as shown in FIGS. 1 and 3. Accordingly, two lateral supporting surfaces 64 of the binding case 28 project beyond the upper surface 46 of the ski body 32 or its side walls. This feature simultaneously enables precise guidance of the ski and maximal force transmission to the ski body 32, in particular during "skating".

As shown in FIGS. 1 and 3, the binding case 28 is further provided on its upper surface with two supporting or guide ribs 66 to be received by corresponding grooves 66A on the underside of the sole, i.e. in the undersurface 14 of the sole of the cross-country ski boot 12 (cf. FIG. 5), which are oriented substantially parallel to the long direction of the ski. In particular, the guide ribs 66 are integrally formed with the binding case 28. In the embodiment shown in FIGS. 1 and 3 the retaining hook 26 is advantageously disposed between the two guide ribs 66, each of which includes a gap 68 at a corresponding place in the region immediately ahead of the retaining hook 26 to form a passage transverse to the long direction of the ski that serves to receive the joint axle 22 of the cross-country ski boot 12.

The method of operation of the binding 10 will now be described.

At first the retaining hook 26 or stirrup piece 36 is in the boot-release position. The joint axle 22 of the cross-country ski boot 12 is then set into or brought to bear within the two corresponding gaps 68 in the guide ribs 66. By rotating the actuating element 40 as shown by the arrow 70 in FIG. 2, the retaining hook 26 is translationally displaced forward in the direction of the arrow 72. The stirrup piece 36 associated with the retaining hook comes into engagement with the joint axle 22 of the cross-country ski boot 12, which at its other side is fixed with respect to the binding case 28 by the back faces 74 of the front guide ribs 66, which delimit the front end of the gaps 68. The retaining hook 26 and its stirrup piece 36 are now in the closed position, as shown in detail in FIGS. 3 and 4. To move the retaining hook 26 with its stirrup piece 36 back from the closed position into the releasing position, the actuating element must be rotated again, but now in the direction of the arrow 76.

Figure 15:
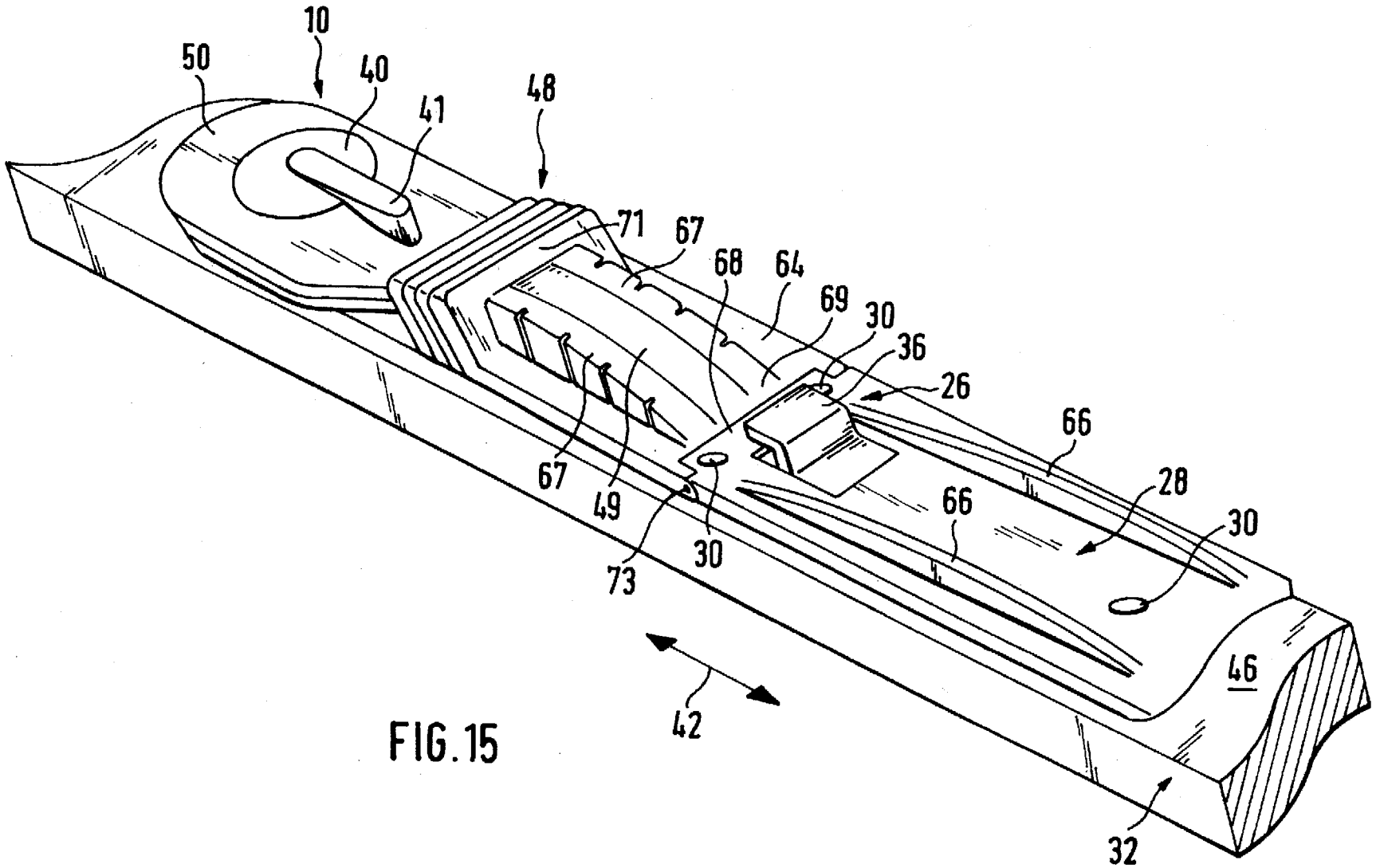
FIG. 15 is a diagrammatic perspective view of a second embodiment of a cross-country ski binding according to the invention attached to a cross-country ski.

In the embodiment shown in FIGS. 15 to 18, the cross-country ski binding 10 likewise includes a flat binding case 28 which, as shown in FIG. 15, is attached to the upper surface 46 of the ski body 32 by means of the screws 30.

The binding case 28 comprises a back, a middle and a front section.

In the front section, as in the binding case described above, an actuating element 40, here comprising an actuating lever 41, is rotatably disposed. By means of the actuating element 40, in the manner described above, the retaining hook 26 with its U-shaped stirrup piece 36 which is slidably disposed in the front part of the back section of the binding case 28, is moved back and forth in the direction of the double arrow 42. The mechanics of this locking mechanism are as described in detail with reference to FIGS. 1–4.

The back section of the binding case 28 includes a surface associated with the back part of the sole of the cross-country ski boot. On this surface there are two guide ribs 66, oriented in the long direction of the ski parallel to and spaced apart from one another, which fit into corresponding grooves on the underside of the sole of the cross-country ski boot for the sideways guidance of the ski.

Toward the front, adjacent to the back section of the binding case 28, a sole-contact element 49 is disposed in the middle section of the binding case, between the back and front sections. It is tiltably mounted in the region of the upper surface 46 of the ski (double arrow 39 in FIG. 16) and comprises a first supporting surface 65 that can be swiveled over an angular range from 2° to 12° with respect to the upper surface 46 of the ski, which is adjoined at its front end by a shorter second supporting or bearing surface 71 that slants upward at an angle of approximately 135° with respect to the supporting surface 65. The two surfaces 65 and 71 are part of an integral component, namely the sole-contact element 49.

The supporting surface 65 supports the part of the sole between the joint axle 22 integrated with the sole and the front end of the sole, while the front end 16 itself abuts against the bearing surface 71.

In the long direction of the ski, parallel to and spaced apart from one another, two guide ribs 67 extend back from the bearing surface 71. The guide ribs 67 fit into correspondingly shaped grooves in the underside of the sole of the cross-country ski boot.

In this embodiment, a resilient restoring element or flexor 48 is disposed between both the underside and the front end of the sole-contact element 49 on the one hand and the binding case 28 on the other hand, so that the sole-contact element 49 can be pressed or swiveled toward the upper ski surface 46 against the action of the restoring element. When no load is applied to the sole-contact element 49, the supporting surface 65 slants upward at an angle of approximately 6° with respect to the upper ski surface 46. If desired, however, other angular positions are possible.

Alternatively, the element 48 can be associated either only with the underside of the sole-contact element 49 or only with its front end.

Transverse bores 76 are provided in two projections at the back end of the sole-contact element 49 and also in the front end of the back section of the binding case 28, which in the assembled state lies between the said two projections. Through the transverse bores 76 an axle 73 can be passed so as to lie parallel to the upper ski surface 46 and perpendicular to the long direction of the ski.

When the sole-contact element 49 is placed under load, it is swiveled downward about the axle 73. In particular, it is provided that the sole-contact element 49 can be swiveled in an angular range from 2° to 12° with respect to the upper ski surface 46. Alternatively, swiveling from 4° to 6° or any another angular range can be provided for.

As shown in FIGS. 15 to 18, the upper side of each guide rib 67 is convex in such a way that at the back end it merges with the supporting surface 65. Similarly, the back guide ribs 66 merge at their front ends with the binding case 28. Thus between the guide ribs 66 of, the binding case and the guide ribs 67 of the sole-contact element 49 there is defined a region 69 within which no guide ribs are present. It is in this intermediate region 69 that the cross-country ski boot is attached to the ski.

For the boot to enter the binding 10 the actuating lever 41 is turned so that the retaining hook 26 is slid into its back position.

The platelike sole-contact element 49, preferably made of a weather-resistant plastics material, is forced by the element 48 into a position in which it is tilted upward at an angle of approximately 6° with respect to the upper ski surface 46.

When the cross-country ski boot is placed on the cross-country ski binding 10 the back part of the sole rests on the back section of the binding case 28 and the front part of the sole rests on the sole-contact element 49 or on the supporting surface 65 thereof; and the front end of the boot or of its sole abuts against the bearing surface 71 of the sole-contact element 49.

The joint axle integrated with the sole of the cross-country ski boot is situated in a region 69 with no guide ribs. The actuating lever 41 is then turned so that the U-shaped stirrup piece 36 moves into its forward, closed position, creating a joint connection between the ski binding and the cross-country ski boot or its joint axle 22.

As the cross-country skier moves forward, when the heel of the cross-country ski boot is lifted up from the ski, the front part of the sole presses the sole-contact element 49 down toward the upper ski surface 46, with corresponding transmission of propulsive and steering forces to the ski.

The front part of the sole of the cross-country ski boot remains engaged with the supporting surface 65 of the sole-contact element 49 at all times, both in the unloaded and in the partly or completely loaded state, because of the resilience of the element 48.

Because the guide ribs 67 of the sole-contact element 49 are completely contained within the correspondingly formed grooves on the underside of the sole of the cross-country ski boot, even when the heel of the boot is maximally raised, a precise lateral guidance of the ski is ensured.

Finally, the front of the cross-country ski boot abuts against the bearing surface 71 of the sole-contact element 49, so that the forces driving the ski forward are well transmitted.

Figure 16:
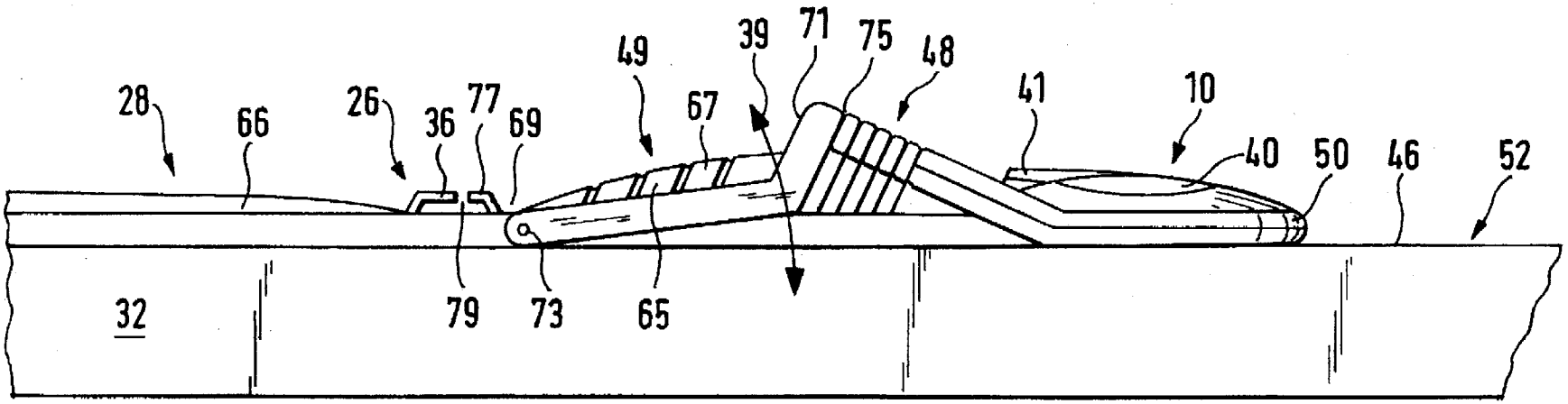
FIG. 16 is a diagrammatic side view of the cross-country ski binding shown in FIG. 15.
Figure 17:
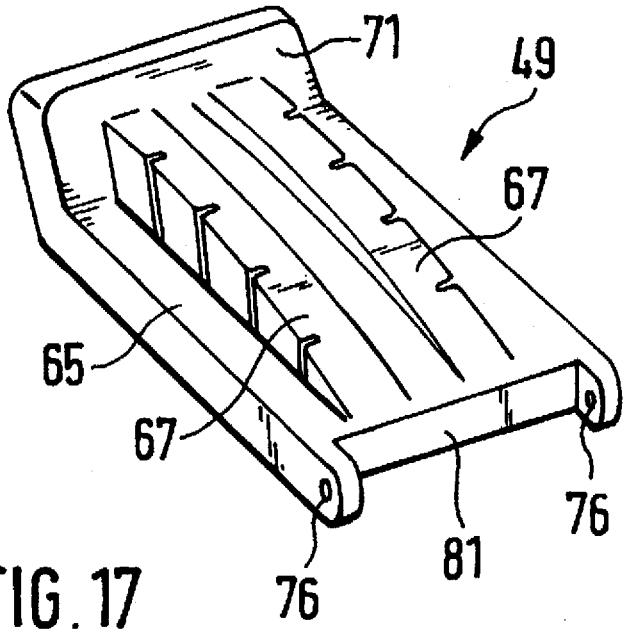
FIG. 17 is a perspective view of a sole-contact element such as is used in the embodiment shown in FIGS. 15 and 16.
Figure 18:
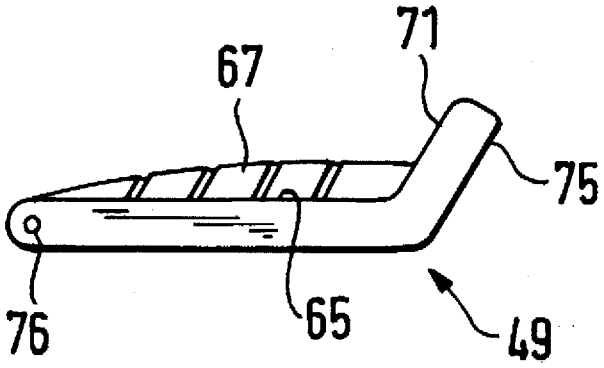
FIG. 18 is a side view of the sole-contact element shown in FIG. 17.

As shown in FIG. 16, a counterpiece 77 can be provided in addition, fixed to the binding case 28 so that it is mirror-symmetric to the U-shaped stirrup piece 36, with the result that when the U-shaped stirrup piece 36 is in its forward position, between it and the counterpiece 77 there is produced a passage 79 transverse to the long direction of the ski, through which the joint axle of the cross-country ski boot extends. The counterpiece 77 can reinforce the action of the bearing surface 71 and likewise transmit the forward-directed forces from the cross-country ski boot to the binding case 28 and hence to the ski. Furthermore, it prevents disengagement between the joint axle and the stirrup piece 36.

Thus the combination described above ensures good transmission of force from boot to ski plus precise guidance, especially during the "skating" commonly employed in ski racing. In addition attention is paid to the anatomy and biomechanics of the foot, so that due to the provision of a sole-contact element 49 that can be swiveled in the direction approximately perpendicular to the upper surface of the ski, the rolling-off and gripping movement of the foot, limited though it may be, is not impeded by unnatural bending of the toe joints.

What is claimed is:

1. A combination of a cross-country ski binding attached to a cross-country ski and a complementary cross-country ski boot having a front toe-end and secured to one another to form a joint connection therebetween, wherein the ski boot comprises:

a sole having an undersurface including a front part including a toe-end and a rearwardly located ball region substantially rearwardly of the toe-end of the sole and adapted to be located in alignment with a ball of a skiing foot within the ski boot, a single joint axle which is disposed in said ball region of the sole and thereby substantially spaced from said toe-end, said axle being located transversely to the long direction of the ski and substantially parallel to the undersurface;

a complementary engagement axle member secured to a cross-country ski and including a movable retaining hook to be positioned between a first position and a second position, an actuating unit secured to the ski and connected to said retainer hook, said actuating unit having a movable member to move said hook between said first and second position, said hook having a lateral opening extending substantially transverse to the ski for receiving the single joint axle, said first position of the hook located in engagement with the joint axle of the boot sole with the hook extending over the joint axle to form a pivot connection, and said second position of said retaining hook being separated from engagement with said joint axle; and a fixed resilient support element secured to a top surface of said cross-country ski in forwardly spaced relation to said joint axle and at least substantially in part beneath said toe-end of the sole said support element engaging said sole beneath said toe-end and establishing an upward force acting as a substantially continuous resilient support beneath the toe-end of said sole and the boot between said joint axle and said toe-end.

2. The combination of claim 1, wherein the resilient support element comprises a flexor located between the ball region and the toe-end of the boot, said sole forward of the joint axle being movable about the joint axle on said flexor only in the range of 2° to 12° from a horizontal position of the ski boot.

3. The combination of claim 2, wherein said range is in the range of 4° to 6°.

4. The combination of claim 1, wherein the undersurface of the sole curves upwardly from the joint axle towards the front end of the sole, said sole rearwardly of said joint axle being a substantially flat horizontal member.

5. The combination of claim 4, wherein the undersurface of the sole curves upwardly so as to form an angle in the range of 2° to 12° with respect to a horizontal plane passing through the joint axle and the sole rearwardly of said joint axle.

6. The combination of claim 4, wherein said range is in the range of 4° to 6°.

7. The combination of claim 1, wherein said binding includes a snow-excluding means located at said front part of the sole and extends upwardly from the ski to prevent snow from moving between the boot and the ski binding.

8. The combination of claim 7, wherein the snow-excluding means includes a substantially U-shaped member including a frontal and rearward portions encircling the boot sole between said ball region and the front end of the sole.

9. The combination of claim 7, wherein said resilient support element includes a flexor connected to said snow-excluding means, said snow-excluding means includes a resiliently deformable member formed integrally with the flexor.

10. The combination of claim 7, wherein the resilient support element includes a flexor immediately beneath the sole extending forwardly from the joint axle to said snow-excluding means, and a binding attachment unit connected to at least one of the flexor and the snow-excluding means and the binding.

11. The combination of claim 10, wherein said attachment unit includes a snap-fit device.

12. The combination of claim 10, wherein the binding comprises a widened region which projects beyond the upper surface of the ski in the area which lies adjacent the ball region and the front part of the sole of the boot, said snow-excluding means including a portion aligned with the widened region for support.

13. The combination of claim 1, wherein the binding comprises a case and the retaining hook comprises a flat element located within the case and slidably mounted to slide back and forth in the long direction of the ski within the case between said first position and said second position, said hook having portions which extend upwardly and horizontally to define a U-shaped stirrup member that in the first position cooperates with the binding case to secure the joint axle of the boot to the binding, an actuating means disposed in the case and connected to said hook, said actuating means being movable to establish a translational back-and-forth movement of the retaining hook between said first position and said second position, said actuating means including a pivotally mounted element having an eccentrical connection to the front end of the retaining hook and forming an articulated connection between the front end of the retaining hook and the U-shaped stirrup member for positioning said hook.

14. The combination of claim 1, wherein the binding includes substantially parallel elongated guide ribs extending in the long direction of the ski, said guide ribs forming a gap extending forwardly from the forward end of the retaining hook and defining an area for guided placement of the joint axle of the boot for connection to said retaining hook.

15. The combination of claim 14, wherein said binding includes a case, said guide ribs being integrally formed with the upper surface of said case.

16. A combination as claimed in claim 13, wherein the complementary engagement means of the binding comprises a second member that cooperates with the U-shaped stirrup member so that when the U-shaped stirrup member is in the first position, there is defined between the second member and the stirrup member a passage into which the engagement means of the sole of the boot extends when the boot is assembled with the binding.

17. A combination as claimed in claim 1, wherein a resiliently mounted sole-contact element is provided between the sole and the upper surface of the ski in the region in front of the joint axle.

18. A combination as claimed in claim 17, wherein the sole-contact element is attachable to the upper surface of the ski.

19. A combination as claimed in claim 18, wherein the sole-contact element is attachable to the upper surface of the ski immediately ahead of the hinge joint between the retaining hook and the joint axle.

20. A combination as claimed in claim 17, where the sole-contact element can be swiveled about an axis through angles in the range from 2° to 12°.

21. A combination as claimed in claim 17, wherein the sole-contact element defines a sole support surface that in an unloaded state lies in a plane at an angle of up to 12° with respect to the upper ski surface.

22. A combination as claimed in claim 17, wherein a front end of the sole-contact element defines a bearing surface against which the front end of the sole of the cross-country ski boot abuts.

23. A combination as claimed in claim 17, wherein the sole-contact element comprises at least one guide rib which is oriented in the long direction of the ski and which can cooperate with an associated, complementarily shaped groove defined by the undersurface of the sole of the boot.

24. A combination as claimed in claims 17, wherein the resiliently deformable element is used to provide the resilient mounting of the sole-contact element, the resiliently deformable element being disposed between the sole-contact element and one of the ski and the binding, and wherein the sole-contact element, the resiliently deformable element and the binding together form a structural unit which is externally sealed so that no snow, ice or dirt can penetrate between the afore-mentioned individual components.

25. A combination as claimed in claim 24, wherein the resiliently deformable element is disposed at the front end of the sole-contact element to resiliently restore the spacing between the boot and a ski.

* * * * *